US008004168B1

(12) United States Patent
Lin

(10) Patent No.: US 8,004,168 B1
(45) Date of Patent: Aug. 23, 2011

(54) LIGHT ASSEMBLY

(76) Inventor: Tung-Hsiung Lin, Taichung (TW)

( * ) Notice: Subject to any disclaimer, the term of this patent is extended or adjusted under 35 U.S.C. 154(b) by 214 days.

(21) Appl. No.: 12/353,257

(22) Filed: Jan. 14, 2009

(51) Int. Cl.
*H01J 5/48* (2006.01)

(52) U.S. Cl. ..... 313/318.04; 313/33; 313/318.01

(58) Field of Classification Search ..... 313/11, 313/12, 20, 33, 317–318.1
See application file for complete search history.

(56) References Cited

U.S. PATENT DOCUMENTS

2003/0080691 A1* 5/2003 Yasuda et al. ..... 315/169.3
2008/0143233 A1* 6/2008 Hein et al. ..... 313/318.08
2010/0103666 A1* 4/2010 Chang et al. ..... 362/234

* cited by examiner

*Primary Examiner* — Bumsuk Won
(74) *Attorney, Agent, or Firm* — Pro-Techtor Int'l Services; Ralph Willgohs

(57) ABSTRACT

A light assembly includes a bulb connected to the passage defined through the base and the base includes a plurality of first slots defined transversely in an outer periphery of the base. A base cover has a space for receiving the base and multiple ventilation holes are defined through a wall of the base cover. A plurality of engaging pieces extend from an inner periphery of the base cover and are engaged with the first slots of the base. The heat generated from the bulb escaped via the ventilation holes.

3 Claims, 6 Drawing Sheets

LIGHT ASSEMBLY

FIELD OF THE INVENTION

The present invention relates to a light assembly, and more particularly, to a light assembly including a base and a base cover which is easily and securely connected with the base to which bulbs are connected.

BACKGROUND OF THE INVENTION

A conventional light assembly is shown in FIG. 6 and generally includes a base 40 and a bulb 41 is connected to the base 40, the bulb 41 is a spiral energy-saving light bulb. The conventional light assembly does not have satisfied heat ventilation deign so that the heat generated from the bulb 41 cannot dispensed quickly and the high temperature may shorten the period of use of the light assembly.

The present invention intends to provide an improved light assembly wherein the base cover includes ventilation holes for quickly dispensing heat from the light bulbs so as to improve the shortcomings of the conventional light assembly.

SUMMARY OF THE INVENTION

The present invention relates to a light assembly which comprises at least one bulb which is engaged with at lest one passage defined through a base. A plurality of first slots are defined transversely in an outer periphery of the base. A base cover has a space defined in a first end thereof so as to receive the base in the space, multiple ventilation holes are defined through a wall of the base cover. A plurality of engaging pieces extend from an inner periphery of the base cover and are engaged with the first slots of the base so as to quickly connect the base and the base cover.

The primary object of the present invention is to provide a light assembly wherein the heat can quickly escape from ventilation holes of the base cover of the light assembly.

Another object of the present invention is to provide a light assembly wherein the base and the base cover are easily and securely connected to each other.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
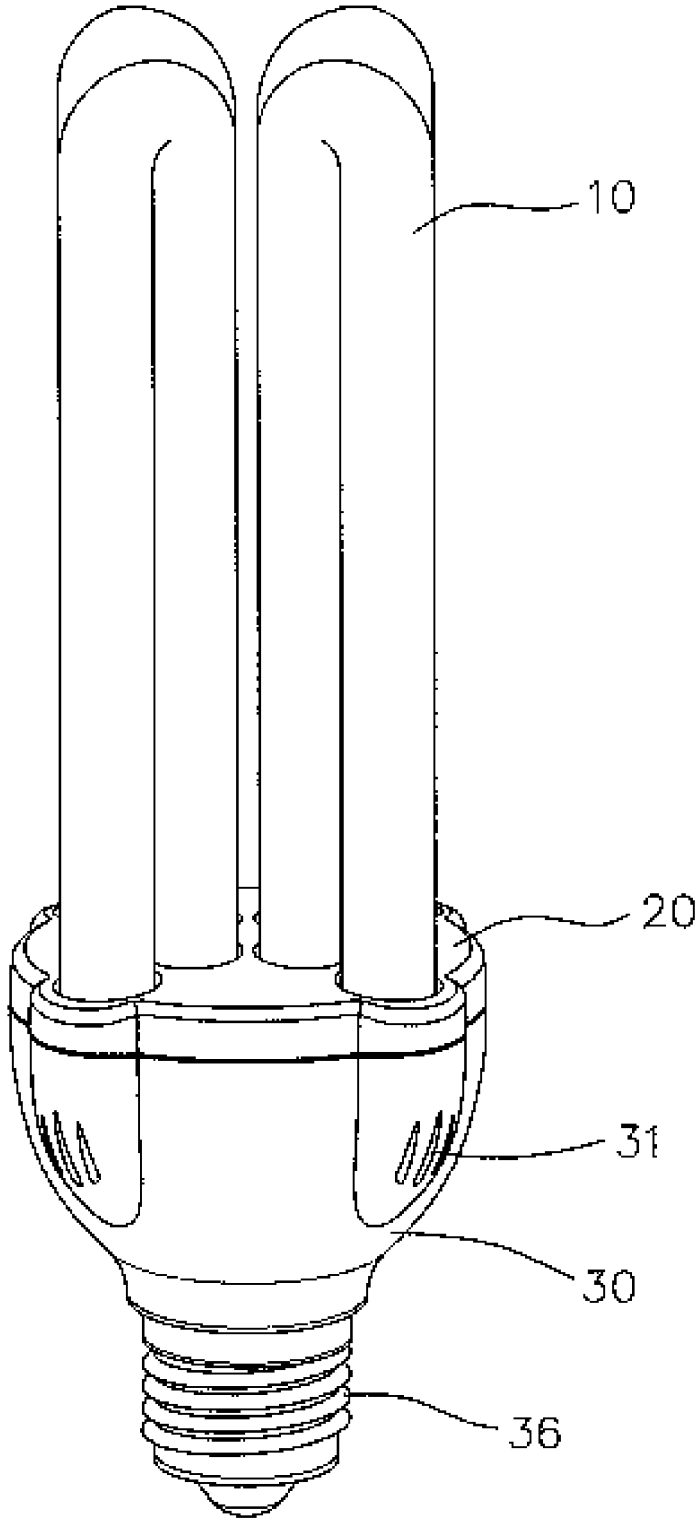
FIG. 1 is a perspective view to show the light assembly of the present invention.
Figure 2:
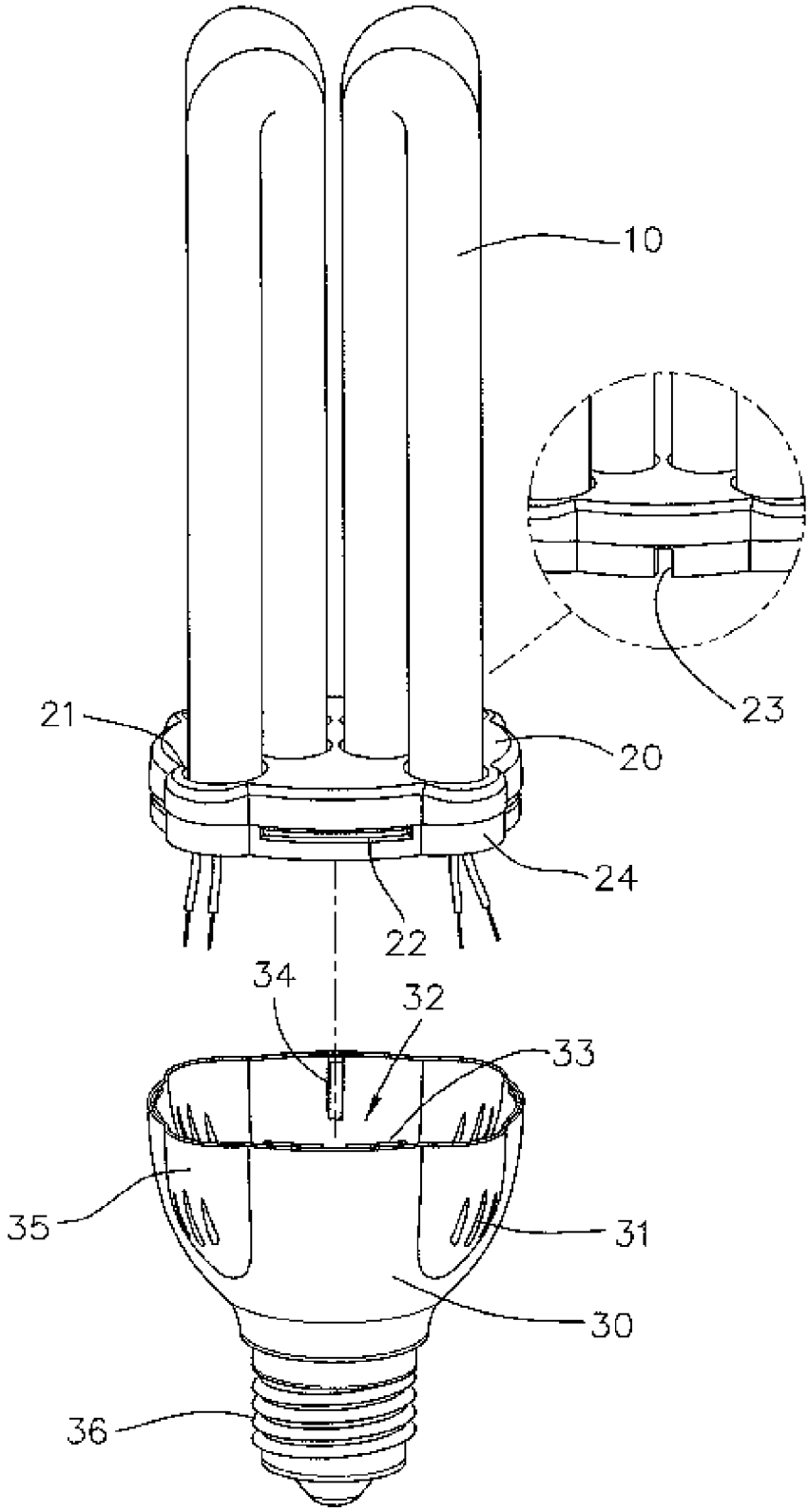
FIG. 2 is an exploded view to show the light assembly of the present invention.
Figure 3:
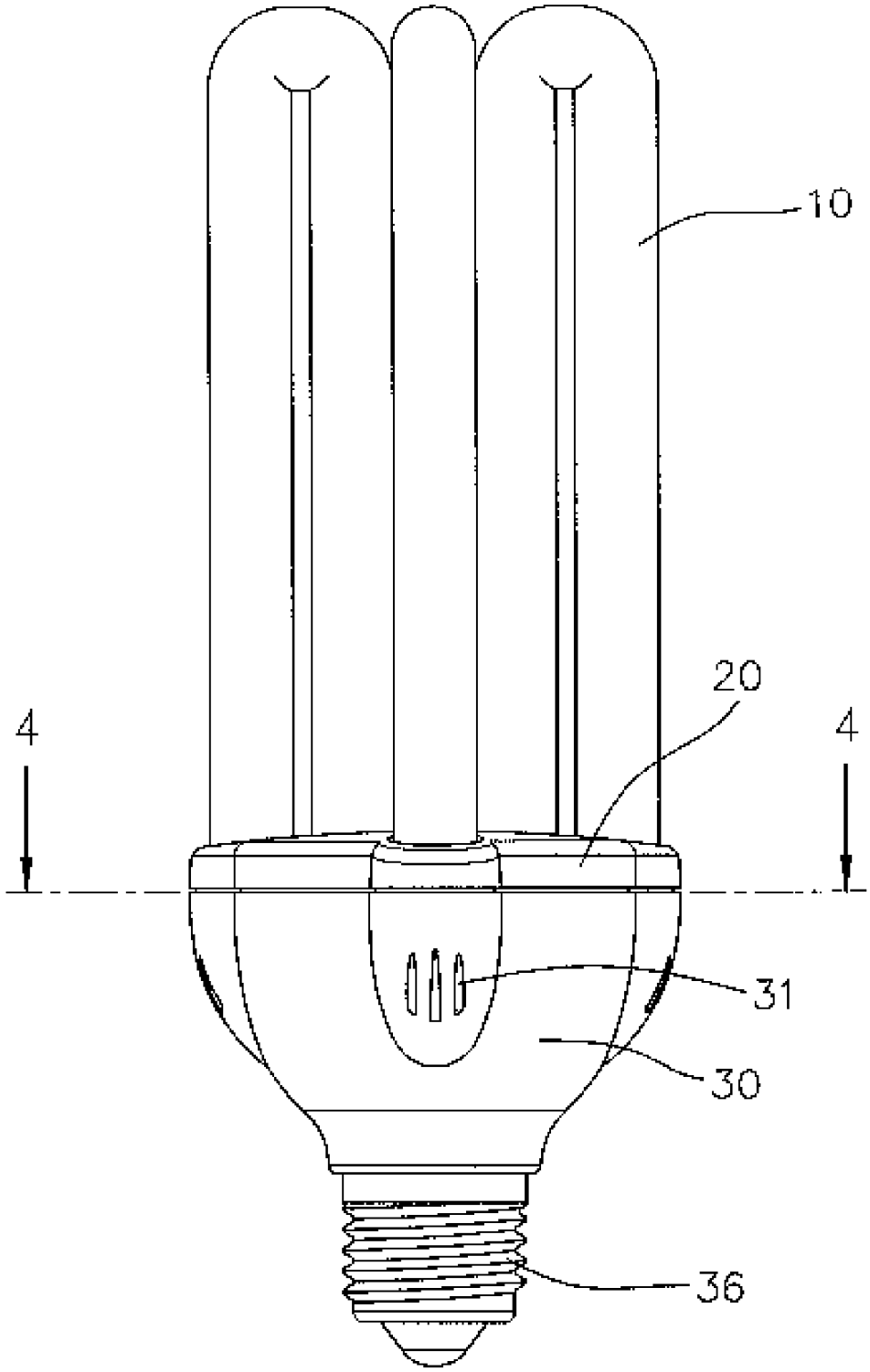
FIG. 3 is a side view of the light assembly of the present invention.
Figure 4:
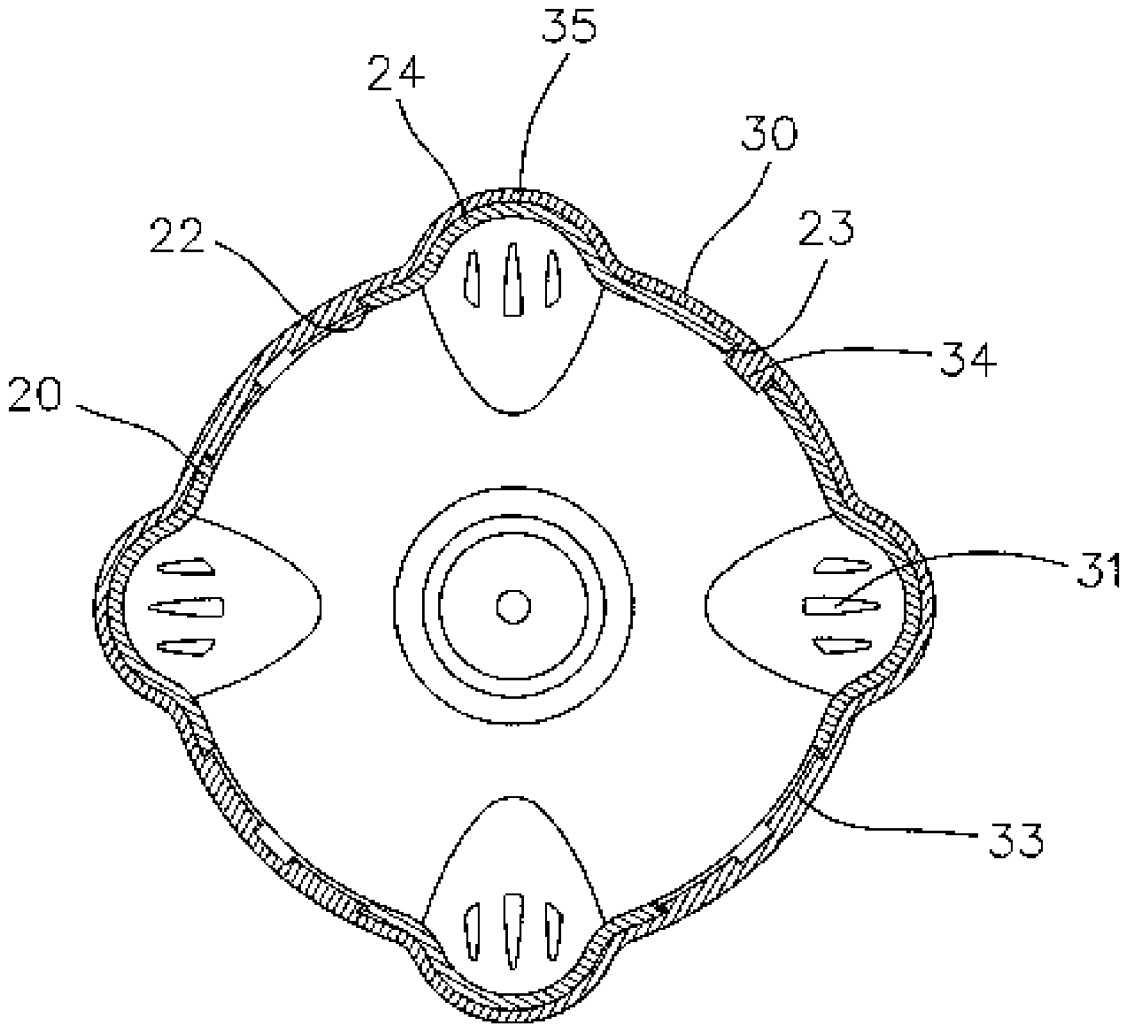
FIG. 4 is a cross sectional view taken along line 4-4 in FIG. 3.
Figure 5:
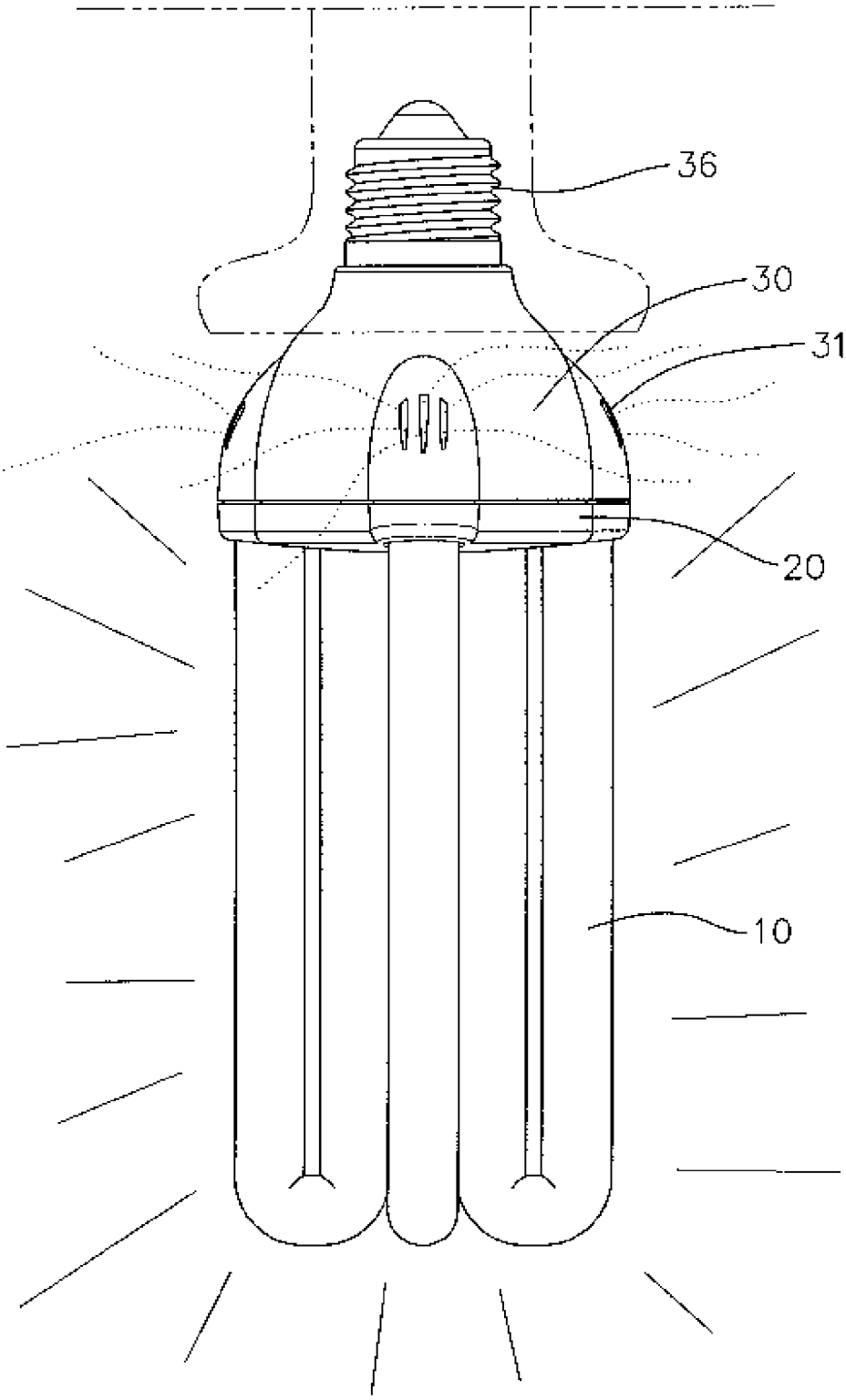
FIG. 5 shows that heat escape from the ventilation holes of the base cover of the light assembly of the present invention.
Figure 6:
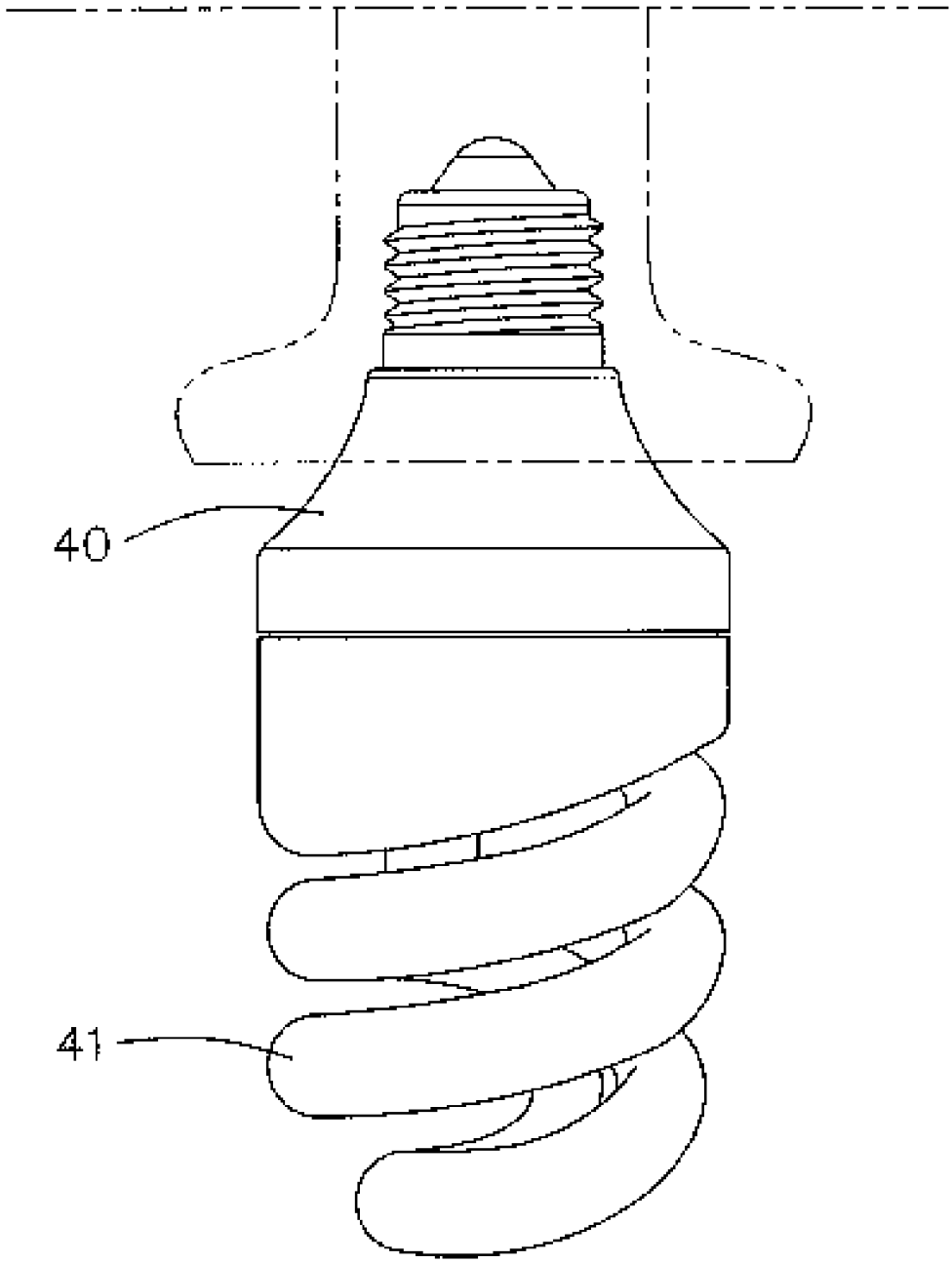
FIG.6 PRIOR ART
FIG. 6 shows a conventional light assembly.

Referring to FIGS. 1 to 5, the light assembly of the present invention comprises four U-shaped bulbs 10 which are engaged with four passages 21 defined through a base 20. The base 20 includes a plurality of first slots 22 defined transversely in an outer periphery thereof and four protrusions 24 extend from the outer periphery of the base 20. A second slot 23 is defined axially in the outer periphery of the base 20.

A base cover 30 has a space 32 defined in a first end thereof and four recesses 35 are defined in an inner periphery of the base cover 30 and communicate with the space 32. A plurality of engaging pieces 33 extend from the inner periphery of the base cover 30 and a ridge 34 extends axially from the inner periphery of the base cover 30. The multiple ventilation holes 31 are defined through a wall of the base cover 30 and located corresponding to the recesses 35. The base cover 30 includes threads 36 defined in an outer periphery of a second end thereof so as to be connected with a socket (not shown).

The base 20 is engaged with the space 32 and the four protrusions 24 are engaged with the recesses 35 of the base cover 30. The engaging pieces 33 of the base cover 30 are engaged with the first slots 22 of the base 20, and the ridge 34 on the base cover 30 is slidably engaged with the second slot 23. By the engagement of the ridge 34 and the second slot 23, the base 20 is easily connected with the base cover 30, and the engagement of the engaging pieces 33 and the first slots 22 securely connects the base 20 and the base cover 30.

The heat generated from the four bulbs 10 escape from the ventilation holes 31 so that the heat will not be trapped in the base cover 30 so as to prolong the period of use of the light assembly.

While we have shown and described the embodiment in accordance with the present invention, it should be clear to those skilled in the art that further embodiments may be made without departing from the scope of the present invention.

What is claimed is:

1. A light assembly comprising: at least one bulb;

a base having at least one passage defined therethrough and the at least one bulb engaged with the at least one passage, a plurality of first slots defined transversely in an outer periphery of the base, a second slot defined axially in the outer periphery of the base and multiple protrusions extending from the outer periphery of the base, and a base cover having a space defined in a first end thereof and multiple ventilation holes defined through a wall of the base cover, the base engaged with the space, the base cover including multiple recesses defined in an inner periphery thereof and the protrusions of the base engaged with the recesses of the base cover, multiple ventilation holes defined through a wall where the recesses are defined, a plurality of engaging pieces extending from the inner periphery of the base cover and engaged with the first slots of the base, the base cover including a ridge which is slidably engaged with the second slot.

2. The assembly as claimed in claim 1, wherein the at least one bulb is a U-shaped bulb.

3. The assembly as claimed in claim 1, wherein the base cover includes threads defined in an outer periphery of a second end thereof.

* * * * *